US006155424A

United States Patent [19]

Dubach

[11] Patent Number: 6,155,424

[45] Date of Patent: Dec. 5, 2000

[54] DEVICE FOR PRESSING OF TABLETS FROM A BLISTER PACK

[75] Inventor: Werner Fritz Dubach, Maur, Switzerland

[73] Assignee: Createchnic AG, Dietlikon, Switzerland

[21] Appl. No.: 09/214,094

[22] PCT Filed: May 23, 1997

[86] PCT No.: PCT/CH97/00203

§ 371 Date: Dec. 28, 1998

§ 102(e) Date: Dec. 28, 1998

[87] PCT Pub. No.: WO98/00353

PCT Pub. Date: Jan. 8, 1998

[30] Foreign Application Priority Data

Jun. 28, 1996 [CH] Switzerland ..... 1624/96

[51] Int. Cl.[7] ..... B65D 83/04

[52] U.S. Cl. ..... 206/531; 206/538

[58] Field of Search ..... 206/528, 531, 206/532, 534, 538, 539

[56] References Cited

U.S. PATENT DOCUMENTS

| | | | |
|---|---|---|---|
| 3,387,699 | 6/1968 | Heller | 206/531 |
| 3,630,171 | 12/1971 | Huck . | |
| 3,904,075 | 9/1975 | Richardson et al. | 206/534 |
| 4,384,649 | 5/1983 | Brodsky . | |
| 4,998,623 | 3/1991 | Doull | 206/531 |
| 5,019,125 | 5/1991 | Rebine et al. | 206/532 |
| 5,050,739 | 9/1991 | Hannan et al. | 206/531 |
| 5,109,984 | 5/1992 | Romick | 206/531 |

FOREIGN PATENT DOCUMENTS 0 547 426 A1 6/1993 European Pat. Off. .

*Primary Examiner*—Jim Foster
*Attorney, Agent, or Firm*—Pauley Petersen Kinne & Fejer

[57] ABSTRACT

A device for pressing of tablets from a blister pack. The device has a base plate and a cover plate. When closed, the two plates connected to each other by a hinge are superimposed in such a manner that openings in the cover plate are arranged substantially over openings in the base plate. The base plate is arranged using fins at a distance from a datum plane. Supporting bumps and embossed edges form a support plane on which the blister pack rests with the cover film thereof, for facilitating punching through the cover film when pressure is exerted on bumps of the deep-drawn plastic film of the blister pack. Tabs with corresponding locking noses lock the device. The device also allows disabled patients to remove the tablets required from the blister pack without further assistance.

9 Claims, 2 Drawing Sheets

DEVICE FOR PRESSING OF TABLETS FROM A BLISTER PACK

BACKGROUND OF THE INVENTION

1. Field of the Invention

This invention relates to a device made of a plastic material for pushing tablets out of a blister pack.

2. Description of Prior Art

Blister packs are often used for dispensing tablets, since they are easily visible and allow controlled dispensation. Such blister packs consist of a deep-drawn plastic foil with respectively one raised portion, in which respectively one tablet can be positioned, which is covered by a welded-on continuous metal foil. To remove the tablets, the package must be held in a hand and the tablet must be pushed through the metal foil by pressing on the raised portion in the plastic foil, with a thumb.

The metal foil often is a printed aluminum foil, but coated aluminum foils, plasticized aluminum foils and plastic foils vapor-plated with a metal coating are also used. The force needed for removing a tablet is a function of the flexural strength of the deep-drawn, mostly transparent plastic foil and also of the toughness of the cover foil.

Because of their illness, some patients have difficulties pushing the tablets out of the blister pack. This applies in particular to patients with Parkinson's disease and those with rheumatic afflictions of the hands. Often such patients are already overtaxed by simple manipulations and have to rely on the help of third parties.

A device for the rapid removal of all tablets from a blister pack is known from U.S. Pat. No. 4,384,649. A base plate has depressions, onto which the blister pack can be placed with the raised portions down, wherein a pivotal stamping plate perforates the cover plate above all raised portions.

Both European Patent Reference 0,547,426 and U.S. Pat. No. 3,630,171 show devices suitable for the individual removal of tablets from blister packs, which have a lower base plate with ribs oriented toward a bearing surface and defining a level of placement with a height greater than a thickness of the tablets to be discharged, wherein the base plate has openings corresponding to a grid of raised portions in the blister pack.

While with European Patent Reference 0,547,426 the cover plate remains closed during the removal of tablets, the same as with the invention, it is necessary with U.S. Pat. No. 3,630,171 to open it. The first-mentioned solution has a connecting link guide in the cover, in which a tappet is slidingly guided.

SUMMARY OF THE INVENTION

It is one object of this invention to provide a device of the type mentioned above, so that handicapped patients can remove a tablet from the blister pack without the assistance of others.

This object is attained by a device with the characteristics mentioned in this specification which includes a description of advantageous embodiments of this invention.

BRIEF DESCRIPTION OF THE DRAWINGS

A preferred embodiment of the subject of the invention is represented in detail in the attached drawings and will be explained by means of the following description wherein.

DESCRIPTION OF PREFERRED EMBODIMENTS

Figure 6:
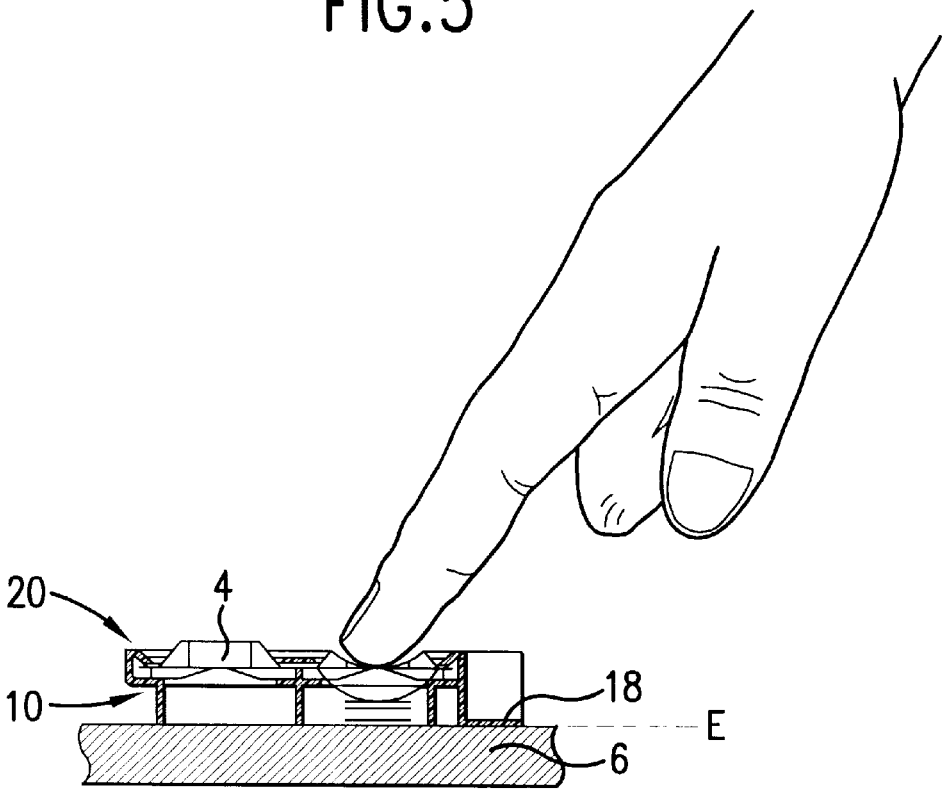
FIG. 6 is a schematic drawing showing use of a device to push a tablet out of the blister pack.

The device in accordance with this invention essentially comprises a base plate 10 and a cover plate 20, pivotally connected therewith. Preferably the cover plate 20 is integrally connected with the base plate 10, and both plates 10, 20 are pivotal with respect to each other about a pivot axis 21. In the present example the pivot axis 21 is constituted by two hinges 22. The hinges 22 are designed as film hinges. A blister pack 2 is shown resting on the base plate 10. The blister pack 2 comprises a deep-drawn plastic foil 3, in which raised portions 4 are formed. The raised portions 4 constitute receptacles for the tablets to be packed. Thus, a tablet T, not shown here, therefore lies in each raised portion 4. Only in FIG. 6 can the tablet T be seen in a pushed-out state. In the course of being pushed out, the tablet T cuts through the cover foil 5 and the raised portion 4 is inverted.

The base plate 10 essentially comprises a flat plate, which has vertically projecting ribs 11 in a direction of a bearing side. The ribs 11 form at least one circumferential edge. However, an additional center rib 11', which is arranged centered between the two longitudinal ribs 11, are preferably provided for reinforcement. Further transverse ribs, which extend crosswise in relation to the longitudinal ribs 11, can be provided. The transverse ribs respectively extend between two adjoining openings 12 in the base plate 10. The height of the ribs 11, 11' is of such a dimension that the thickness is greater than a thickness of the tablets 7 to be pushed out. The lower edges of all ribs define a level E of placement. In the course of using the device 1, therefore the level of placement comes to rest on a bearing surface 6. Thus, the level E of placement and the bearing surface 6 are congruent.

So that the blister pack rests in a correct arrangement on the base plate 10, short positioning projections 13 are laterally arranged, which extend vertically to the longitudinal edge. The positioning projections 13 are used for engaging lateral recesses 7 of the blister pack to be inserted. Preferably the base plate 10 has an upwardly drawn circumferential wall 14, on which the cover plate 20 rests in the closed state of the device 1. This solution should be preferred, because in one preferred embodiment represented here the cover foil 5 of the blister pack 2 is not seated directly on the base plate 10. The slightly spaced-apart seating of the blister pack 2 on the base plate 10 is provided by supporting rib-shaped elevations 15. These supporting elevations form a grid, wherein one tablet becomes positioned in each one of the fields defined in this way. The fields 16 respectively have an opening 12 arranged centered in them, which therefore rests vertically under one respectively raised portion 4 of the blister pack 2. Embossed edges 17 are provided at a longitudinal edge of the openings 12, each of which has an approximately rectangular shape. By pressure on the raised portion 4, the embossed edges 17 perforate the cover foil at the edge of the respective raised portion 4 to which pressure is applied. In this way the upper edges of all embossed edges 17 and the surfaces of the supporting rib-shaped elevations 15 on the base plate 10 form a common support plane on which the blister pack 2 rests. The base plate 10 additionally can have thickened sections, which extend up to this support plane and provide an additional supporting effect.

Figure 1:
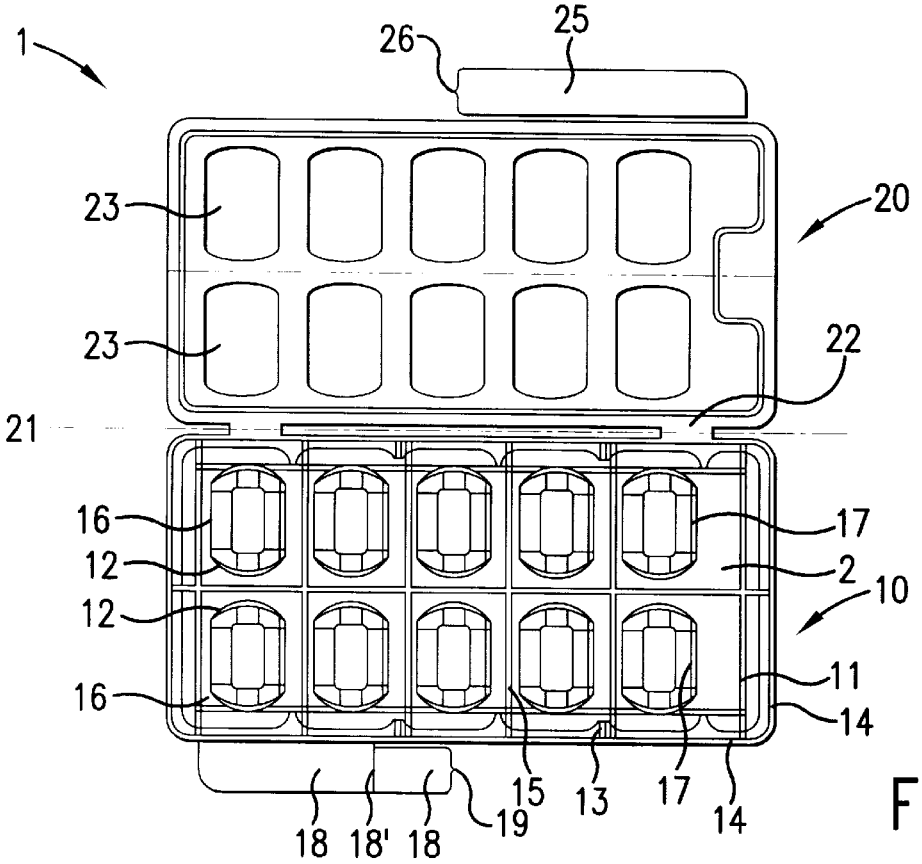
FIG. 1 is a top view of an opened device with a blister pack inserted.
Figure 2:
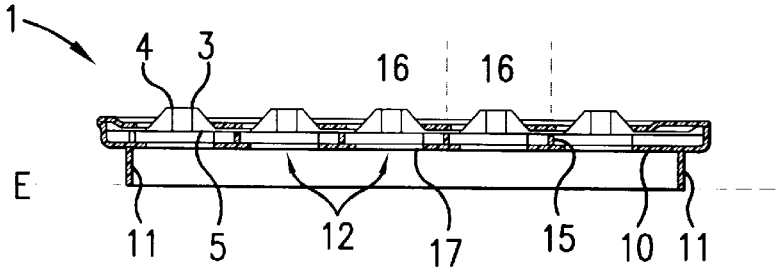
FIG. 2 is a vertical sectional view taken through a closed device with a blister pack inserted.
Figure 3:
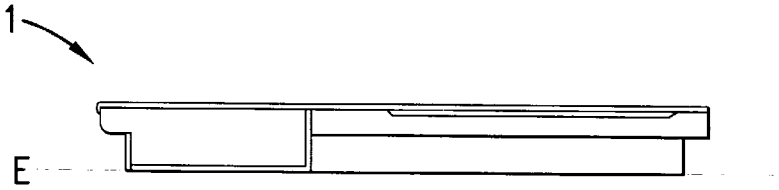
FIG. 3 is a side view of the closed device with a view on a catch.
Figure 4:
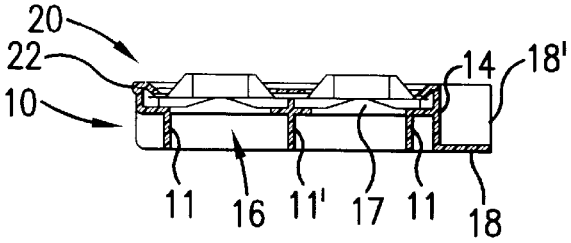
FIG. 4 is a vertical sectional view taken perpendicular to a longitudinal edge of the device.
Figure 5:
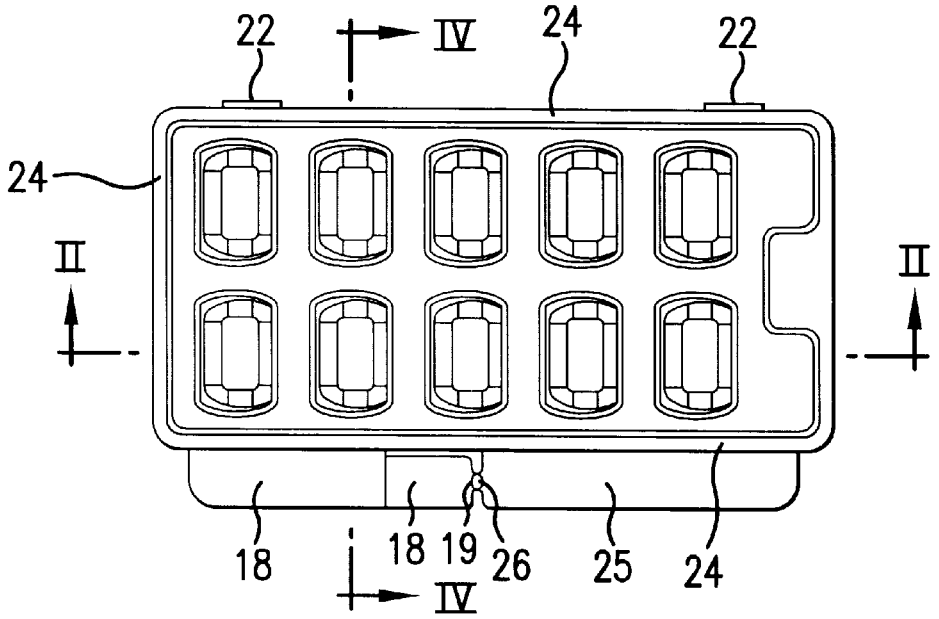
FIG. 5 is a top view of a blister pack inserted, in a closed state.

The cover plate 20 is designed diametrically opposed in relation to the cover plate 10. Therefore the cover plate 20 has the same number of openings 23 which, in the closed state of the device 1, come to rest approximately congruently over the openings 12 in the base plate 10. The cover plate 20 is drawn down with respect to a circumferential edge 24 by a step of approximately the thickness of the material in order to press in the closed state of the device 1 on the inserted blister pack 2. A tongue 25 is arranged in the same plane as the cover plate 20, which is drawn down by the amount of the thickness of the material, on the longitudinal edge located opposite the hinges 22. On its lateral edge located toward the center, the tongue 25 has a catch projection 26. On the longitudinal edge of the base plate 10 located opposite the hinge 22, a tongue 18 is also provided which, in a first area, extends in the level of placement E, and is then raised via a step 18' to the level of the upper edge of the bordering wall 14. This tongue 18 also has at the center lateral edge a catch projection 19 which, in the closed position of the device 1, meshes with the catch projection 26 on the tongue 25 of the cover plate 20. Thus, both catch projections 19 and 26 overlap as shown in FIG. 5.

A device embodied in this way can be made in one piece from plastic and therefore is very cost-effective. The device 1 can be given to a patient without charge by the drugstore, together with the appropriate tablets packed in blister packs. In many cases such patients always require the same tablets over an extended term of therapy. Therefore the device 1 can be used again and again. The tablets packed in this way can be pushed out considerably more easily by a handicapped patient. The packaging itself need not be held in the hand, but can be placed, maintained in the device 1, on a bearing surface 6, for example a table top, and the tablet can be pushed out only by finger pressure. Thus, the tablet comes to rest on the table top and the device can be lifted off. In this case the circumferential edge assures that the tablet does not roll away. Patients with particularly painful rheumatism of the joints of the hands can also push the tablets out of the blister pack by pressure by the elbows on the raised portions 4 projecting upward through the openings 23 of the cover plate 20.

What is claimed is:

1. In a device (1) of a plastic material for pushing tablets (T) out of a blister pack (2), wherein the device (1) has a lower base plate (10) with ribs (11) oriented toward a bearing surface (6) and defining a level (E) of placement with a height greater than a thickness of the tablets (T) to be pushed out, wherein the base plate (10) has openings (12) corresponding to a grid of raised portions (4) in the blister pack (2) to be placed on the base plate (10), and a cover plate (20) is fastened to the base plate (10) pivotal about a longitudinal edge of the base plate (10), the improvement comprising: the cover plate (20) having a plurality of first openings (23) which are essentially congruent with a plurality of second openings (12) in the base plate (10), the cover plate (20) pivotal about a pivot axis (21) onto the base plate (10) so that the raised portions (4) of a blister pack (2) inserted between the base plate (10) and the cover plate (20) project upward through the first openings (23) in the cover plate (20) in a closed state of the device (1), the ribs (11) defining the level (E) forming a circumferential edge, and a supporting rib (11') centered between the second openings (12) and extending parallel with the longitudinal edge and terminating in the level (E).

2. In the device in accordance with claim 1, wherein a plurality of upward extending positioning projections (13) are laterally arranged on the base plate (10) and are used to engage a plurality of lateral recesses (7) in the blister pack (2).

3. In the device in accordance with claim 1, wherein catching means (19, 26) are locked with each other and are provided on the base plate (10) and on the cover plate (20).

4. In the device in accordance with claim 3, wherein the catching means comprise one tongue (18, 25) arranged on the longitudinal edge opposite the pivot axis (21) and which has a catch projection (19, 26).

5. In the device in accordance with claim 1, wherein the base plate (10) has an upward drawn circumferential bordering wall (14) on which the cover plate (20) rests in the closed state.

6. In a device (1) of a plastic material for pushing tablets (T) out of a blister pack (2), wherein the device (1) has a lower base plate (10) with ribs (11) oriented toward a bearing surface (6) defining a level (E) of placement with a height greater than a thickness of the tablets (T) to be pushed out, wherein the base plate (10) has openings (12) corresponding to a grid of raised portions (4) in the blister pack (2) to be placed on the base plate (10), and a cover plate (20) is fastened to the base plate (10) pivotal about a longitudinal edge of the base plate (10), the improvement comprising: the cover plate (20) having a plurality of first openings (23) which are essentially congruent with a plurality of second openings (12) in the base plate (10), the cover plate (20) pivotal about a pivot axis (21) onto the base plate (10) so that the raised portions (4) of a blister pack (2) inserted between the base plate (10) and the cover plate (20) project upward through the first openings (23) in the cover plate (20) in a closed state of the device (1), and a sharp-edged, upward oriented embossed edge (17) placed along at least one edge of each one of the second openings (12) in the base plate (10).

7. In the device in accordance with claim 6, wherein an upward oriented, supporting rib-shaped elevation (15) which is at least of a same height as the embossed edge (17) is provided along at least one edge of each opening at least on a side opposite the embossed edge (17).

8. In the device in accordance with claim 7, wherein a plurality of supporting elevations are on the base plate (10) laterally of the approximately rectangular second openings (12), which with the embossed edge (17) are located in a support plane on which the blister pack (2) rests with the foil (5).

9. In the device in accordance with claim 6, wherein a plurality of supporting elevations are on the base plate (10) laterally of the approximately rectangular second openings (12), which with the embossed edge (17) are located in a support plane on which the blister pack (2) rests with the foil (5).

* * * * *